United States Patent [19]

Gibson

[11] Patent Number: 4,625,491

[45] Date of Patent: Dec. 2, 1986

[54] ELEVATED FLOOR PANEL WITH INTEGRAL TRIM

[75] Inventor: Franklin E. Gibson, Ellicott City, Md.

[73] Assignee: Donn Incorporated, Westlake, Ohio

[21] Appl. No.: 817,893

[22] Filed: Jan. 13, 1986

[51] Int. Cl.[4] ..... E04C 2/34

[52] U.S. Cl. ..... 52/794; 52/126.6; 52/311; 52/783

[58] Field of Search ..... 52/794, 783, 126.6, 52/126.5, 311; 428/192, 201–207

[56] References Cited

U.S. PATENT DOCUMENTS

| | | | |
|---|---|---|---|
| 2,717,187 | 9/1955 | Morgan et al. | 52/783 |
| 2,957,737 | 10/1960 | Irwin et al. | 52/783 |
| 3,548,559 | 5/1969 | Levine | 52/794 X |
| 3,696,578 | 10/1972 | Swensen et al. | 52/126.6 |
| 3,703,431 | 11/1972 | Kemper | 52/311 X |
| 4,067,156 | 1/1978 | Downing, Jr. | 52/126 |
| 4,113,219 | 9/1978 | Mieyal | 248/354 |
| 4,426,824 | 1/1984 | Swensen | 52/794 |
| 4,561,232 | 12/1985 | Gladden et al. | 52/126.6 X |

FOREIGN PATENT DOCUMENTS

| | | | |
|---|---|---|---|
| 429301 | 5/1935 | United Kingdom | 52/783 |

*Primary Examiner*—J. Karl Bell

*Attorney, Agent, or Firm*—Pearne, Gordon, Sessions, McCoy, Granger, & Tilberry

[57] ABSTRACT

A floor panel for elevated floors and the like is disclosed in which a high-pressure laminate floor covering is laminated to the load surface of the panel base. The laminate is provided with a decorative exposed surface and an inner body portion rearwardly therefrom having a color contrasting with the decorative exposed surface. A border is provided around the edge of the panel by cutting away the decorative surface to expose the contrasting inner body portion.

13 Claims, 4 Drawing Figures

ELEVATED FLOOR PANEL WITH INTEGRAL TRIM

BACKGROUND OF THE INVENTION

This invention relates generally to floor structures, and more particularly to a novel and improved elevated floor panel of the type which is supported at its corners on pedestals.

PRIOR ART

Elevated floors, sometimes referred to as "computer floors" or "access floors," are well known. Such floors usually include an array of square floor panels which cooperate to provide an area of flooring. Such panels are supported at their corners on pedestals so that a space is provided between the floor panels and the building supporting structure through which wiring and other services may be routed. Examples of such elevated floors are illustrated in U.S. Pat. Nos. 4,067,156; 4,113,219; and 4,426,824.

Such floor panels are often provided with some form of floor covering laminated to the upper surface thereof to provide a finished, exposed floor surface. Such floor covering may, for example, be carpeting, a vinyl asbestos tile, generally referred to as "VAT," or a high-pressure laminate, usually referred to as "HPL." When such floor covering is laminated to the upper surface of the individual panels, an attractive floor appearance is provided, even though individual panels can be removed with relative ease to provide access to the underfloor space.

Generally in the past, it has been the practice, particularly when a floor covering is laminated to the upper surface of the panel, to provide a separate trim strip around the panel, usually of a color which contrasts with the color of the remaining floor covering. An example of such an arrangement is illustrated in U.S. Pat. No. 3,548,559. Such trim strips tended to provide an aesthetically desirable appearance, and also tended to protect the edges of the floor covering from damage when loads were moved across the floor. Such trim strip increases the cost of the panel and tends to come loose. Further, the joint between the trim strip and the remaining floor covering tends to collect dirt and moisture, which in time causes the bond with the panel base to deteriorate.

SUMMARY OF THE INVENTION

In accordance with the present invention, a novel and improved combination of an elevated floor panel and floor covering is provided. The floor covering is of a type in which the color or the appearance of the upper surface of the floor covering differs from the color or appearance of the body material forming the floor covering which is spaced back from the upper surface.

For example, high pressure laminate floor covering is provided with a decorative paper layer which is exposed to view but is covered by a protective coating, such as melamine or other phenolic resin. Such protective coating is sufficiently transparent that the decorative paper is visible therethrough and provides the principal appearance feature of the floor covering. Rearwardly of the decorative paper, the floor covering material is provided with layers of material having a contrasting color with respect to the decorative paper.

In accordance with the present invention, the surface layer of protective material and the layer of decorative paper are cut away along the edge of the floor covering to expose the inner layers and provide a contrasting color integral border within the floor covering material itself. Further, it has been found that such border zone of reduced thickness is not as susceptible to objectionable cracking or chipping when loads are moved across the floor, so that the need for separate border trim strip is eliminated without eliminating the benefits derived therefrom. Further, when the contrasting color is dark, such as black or colors approaching black, any chipping or cracking which might occur is not as noticeable.

With this invention, it is not necessary to provide a separate trim strip which tends to become loose, and the prior art moisture and dirt collecting groove is eliminated.

With the present invention, an attractive, more durable product is achieved at reduced cost. Further, since the trim portion is integral and is not separately attached to the panel, it can be narrower than the typical trim strip.

These and other aspects of this invention are illustrated in the accompanying drawings, and are more fully described in the following specification, wherein.

DETAILED DESCRIPTION OF THE DRAWINGS

Figure 1:
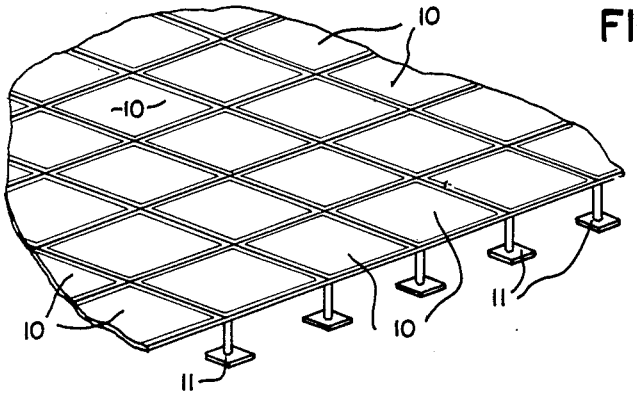
FIG. 1 is a fragmentary, perspective view of an elevated floor in accordance with the present invention.
Figure 2:
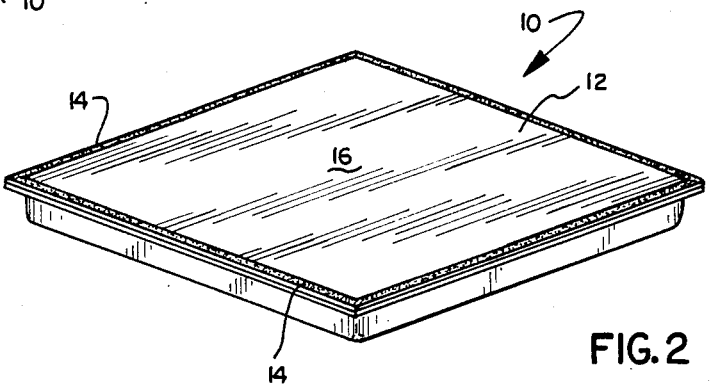
FIG. 2 is a perspective view of a single panel in accordance with the present invention at enlarged scale.
Figure 3:
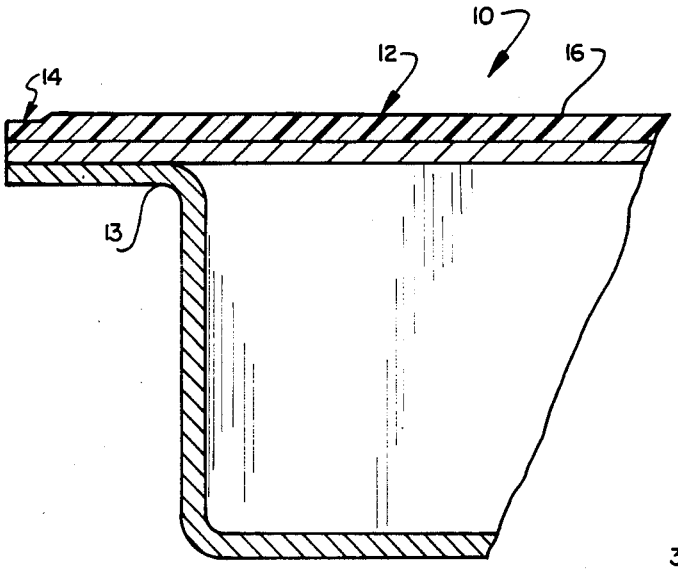
FIG. 3 is a fragmentary cross section of the panel of FIG. 2 at an enlarged scale.

FIG. 1 schematically represents a typical elevated floor system in accordance with the present invention. In such system, an array of panels 10 are supported at their corners on pedestals 11 which rest on the supporting structure of the building (not illustrated). In the illustrated embodiment, the floor panels are square and are supported at their four corners.

Each of the panels provides a decorative upper surface 12 which is laminated to a panel base 13. In the illustrated embodiment, the floor covering 12 is formed of a high pressure laminate and the panel base is formed of sheet metal. It should be understood that the present invention may be applied to other types of panel bases, and that the present invention is not limited to metal panel bases per se.

As discussed in detail below, the edges of the floor covering 12 provide an integral border or edge trim 14 which is preferably a contrasting color with respect to the central portions 16 of the floor covering, and is also preferably provided with a uniform color. The central portion 16, however, is often provided with a pattern including multiple colors so as to provide an attractive appearance. Further, the border or trim 14 is generally provided with a relatively dark color so that any small openings which might exist between adjacent panels tend to be obscured.

As indicated above, the past practice has been to provide a separate trim strip around the edges of the panel which is separately secured to the panel edge adjacent to the central portion of the floor covering. Such prior strips are often formed of a PVC extrusion or molding. Because the prior art strips are separately produced, and are separately secured to the panel body, a joint exists between the edge of the central portion of the panel covering and the strip. Such joint tends to collect moisture or dirt. When moisture penetrates into such joint, it tends to be retained and, over a period of time, can cause the adhesive used to bond the central portion to the body to deteriorate along the edge. This is particularly troublesome at the corners where any looseness in the covering can result in damage to the covering when loads are applied and removed from the floor surface. Further, because the strip is relatively narrow, it is difficult to ensure that the trim strip is adequately maintained in its mounted position as traffic moves across the floor, and also when the panels are removed and/or replaced to provide access to the underfloor space 17.

Figure 4:
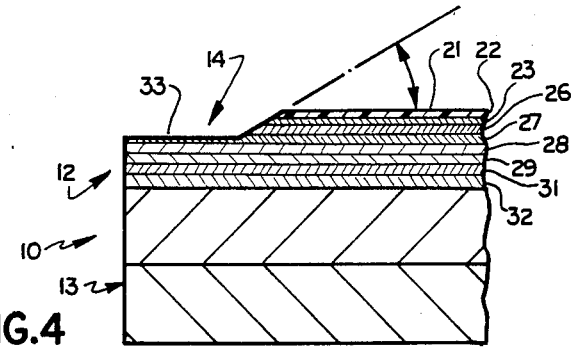
FIG. 4 is is a fragmentary section at greatly enlarged scale, taken along the edge of the panel, illustrating the structural detail of the floor covering in the border or trim zone thereof.

In accordance with the present invention, a single piece of floor covering 12 is adhesively bonded to the body 13 and is provided with an edge trim 14 in the manner best illustrated in FIG. 4. In such embodiment, a high pressure laminate is used having the following structure. The upper surface 21 is provided by a layer of clear resin 22. Positioned immediately beneath the clear resin layer 22 is a decorative layer 23, usually formed of a layer of paper on which a decorative pattern is printed. Immediately beneath the decorative layer 23 are four layers of black paper 26, 27, 28, and 29. Immediately below the lowermost layer of black paper 29 are several layers of brown paper 31 and 32. It should be understood that in some instances, additional layers of brown paper are also provided.

The various layers 23 through 32 are impregnated with a resin, such as a phenolic resin, and are laminated under heat and pressure so as to produce a strong, very wear-resistant assembly or floor covering 12 in which the decorative layer 23 is visible through the clear resin layer 22. Such types of high pressure laminates are manufactured under the trade name "Formica" and other trade names, and are well known to persons skilled in the art. Further, the resin is often a melamine resin. Such laminates provide a very durable floor covering which is attractive, provides abrasive resistance meeting industry standards, and is easily cleaned.

As best illustrated in FIG. 4, the floor covering 12 is scarfed or cut away along its edge at 33 to a depth which removes the clear resin layer 22 and the decorative layer 23 to expose one of the black paper layers. Preferably, the scarfing operation is performed so as to remove the first black paper layer 26 and a portion of the second layer 27, in order to ensure that the decorative layer is removed at all locations along the trim 14 and a uniform exposure of the layers of black paper is obtained. Because there are four black paper layers in the illustrated embodiment, a sufficient depth of such layers exists to ensure that the trim 14 provides a uniform exposure of black layers and does not result in exposing any of the brown layers 31 and 32. Further, it is preferable to provide a structure in which at least two of the black layers remain.

There are a number of advantages to the present invention. Because the trim is an integral part of the floor covering 12, there is no joint between the floor covering and the trim portion in which dirt or moisture can collect. Consequently, the system is easier to clean and a tendency for moisture to deteriorate the bond does not exist. Any moisture which does exist does not collect within the system, but merely passes down between the panels. Further, the problem of the trim's becoming loose as experienced in the prior art does not exist. Still further, the difficulty encountered in securing a separate strip of trim material to the panel base is eliminated, so that the cost of manufacture is reduced. Additionally, it is possible to form a narrower trim width with the present invention than is practical when the prior art separate strip is utilized. For example, the width of the scarfed portion, which is the width of the trim portion, can be less than one-tenth inch; however, when a separate strip is involved, mounting considerations require the strip to be substantially wider.

Further, the edge alignment of the floor covering and the edge of the body of the panel is easily maintained with closer tolerances. The preferred method of producing the panel is to form the scarf along the edges of a piece of floor covering which is slightly oversized. Such oversized piece is then adhesively bonded to the upper surface of the panel base and is trimmed back to be flush with the edge of the panel base by a trimming process utilizing the edge of the panel base as a guide. With such a method of production, the edge dimensions of the floor covering can be easily maintained with respect to the panel base to very close tolerances.

Further, the combination panel in accordance with the present invention is better able to withstand the wearing conditions which occur in use. Because the panels are supported at their corners, a load, whether rolling or otherwise, moving across the floor from one panel to the next at the midspan of the sides of the panels, causes deflection of the panels. As the load approaches the edge of one panel, the load supporting panel deflects downwardly a small amount below the level of the adjacent panel edge. Then as the load engages the edge of the adjacent panel and moves onto such panel, the adjacent panel deflects downwardly a small amount because the load is then supported by the adjacent panel. Because of this deflection, although slight, there is a tendency for the load to cause a minor deterioration of the panel edge in the form of small chipping and the like. If the decorative layer is chipped, as would occur if the decorative layer extended to the edge of the panel assembly, such chip would be very noticeable. On the other hand, small chips in the trim portion merely expose lower layers of the black paper which are the same color, and such chips are not noticeable. It is for this reason that it is desirable to arrange the construction so that two or more black layers remain after the scarfing operation so that increased depth of the black backing material remains when compared to the thiciness of the decorative layer.

It should be understood that although the illustrated embodiment employs backing layers of a black color, the backing layers corresponding to the layers 26 through 29 may be formed of other colors, which should preferably contrast with the color of the decorative layer 23. However, it is desirable that these backing layers, even if formed of other colors, be uniform in their color so that a uniform appearance is provided along the trim portion.

Although the preferred embodiment of this invention has been shown and described, it should be understood that various modifications and rearrangements of the parts may be resorted to without departing from the scope of the invention as disclosed and claimed herein.

What is claimed is:

1. A floor panel for elevated floors comprising a rectangular base structure adapted to be supported at its corners and providing a load surface operable to support loads thereon, a floor covering mounted on said load surface providing a decorative exposed surface layer on the side thereof opposite said load surface, said floor covering providing an inner body portion having an appearance contrasting with the appearance of said decorative surface layer, said floor covering providing a border along the edges of said panels along which said decorative surface layer is removed to expose said inner body portion and thereby provide an integral contrasting border around said decorative surface layer.

2. A floor panel for elevated floors as set forth in claim 1, wherein said inner body portion provides a uniform color and is thicker than said decorative surface layer.

3. A floor panel for elevated floors as set forth in claim 2, wherein said inner body portion includes a plurality of inner body layers, at least two of said inner body layers remaining along said border.

4. A floor panel for elevated floors as set forth in claim 3, wherein said decorative layer and said inner body layers are laminated with a phenolic resin under heat and pressure.

5. A floor panel for elevated floors as set forth in claim 4, wherein said inner body layers have a uniform color contrasting with said decorative layer, and said floor covering provides additional backing layers on the side of said inner body layers remote from said decorative layer.

6. A floor panel for elevated floors as set forth in claim 5, wherein said border is about one-tenth of an inch wide.

7. A floor panel for elevated floors as set forth in claim 6, wherein said base structure deflects a small amount when a load is applied to the midspan of an edge thereof.

8. A floor panel comprising a rectangular support structure providing a load surface operable to support loads thereon, a layered laminated floor covering mounted on said load surface providing a single visible decorative layer along the side of said floor covering remote from said load surface, said floor covering also providing an inner layer contrasting with said decorative layer having a thickness substantially greater than the thickness of the decorative layer adjacent to said decorative layer along the side thereof facing said load surface, said floor covering providing a border extending along the edges of said panel along which the decorative layer is removed to expose said inner layer.

9. A floor panel as set forth in claim 8, wherein said inner layer includes a plurality of layers of paper laminated together with said decorative layer by a resin, at least two of said inner layers remaining along said border.

10. A floor panel as set forth in claim 8, wherein said inner layer includes at least four layers of paper laminated with a resin, and at least one inner layer is removed along said border.

11. A floor panel as set forth in claim 10, wherein said panel is supported at its corners on pedestals.

12. A floor panel as set forth in claim 10, wherein said inner layer is black.

13. A method of forming floor panels comprising producing a panel base providing a load surface, selecting a floor covering having a decorative exposed surface and a contrasting inner body portion behind said exposed surface, sizing said floor panel to fit said load surface with overhang around the edges of said load surface, cutting away a portion of said decorative surface to expose said body portion and thereby produce a border around said decorative surface, adhering said floor covering to said load surface, and trimming said floor covering back to a location flush with the edge of said load surface while leaving a portion of said border.

* * * * *

US004625491C1

(12) EX PARTE REEXAMINATION CERTIFICATE (7033rd)

United States Patent
Gibson

(10) Number: US 4,625,491 C1
(45) Certificate Issued: Sep. 1, 2009

(54) ELEVATED FLOOR PANEL WITH INTEGRAL TRIM

(75) Inventor: Franklin E. Gibson, Ellicott City, MD (US)

(73) Assignee: Tate Access Floors Leasing, Inc., Wilmington, DE (US)

Reexamination Request:
No. 90/006,063, Jul. 19, 2001

Reexamination Certificate for:

| | |
|---|---|
| Patent No.: | **4,625,491** |
| Issued: | **Dec. 2, 1986** |
| Appl. No.: | **06/817,893** |
| Filed: | **Jan. 13, 1986** |

(51) Int. Cl.
*E04C 2/34* (2006.01)

(52) U.S. Cl. ..... 52/791.1; 52/126.6; 52/263; 52/782.2

(58) Field of Classification Search ..... None
See application file for complete search history.

(56) References Cited

U.S. PATENT DOCUMENTS 2,717,187 A * 9/1955 Morgan et al. ..... 52/796.11
3,767,516 A 10/1973 Brady ..... 161/2

FOREIGN PATENT DOCUMENTS

FR 2 292 823 11/1975
FR 2 349 420 4/1976

OTHER PUBLICATIONS

Liskey Aluminum, Inc., "Elaflor: Standard Specification Sheet," In Elaflor Liskey Aluminum Inc. 1960.

Robertson Company, H. H., "Specifications," 1984.

Tate Architectural Products, Inc., "Sweet's Architectural Catalog File," by McGraw Hill Information Systems Company, New York 1967, pp. 3, 7.

Kosbab, George, et al., "Volume I Plastic Laminate Instruction Manual," In *Plastic Laminate Instruction Manual,* 1971 by Formica Corporation: Cincinnati, Ohio, (Copy No. 35), pp. 31, 55–62 and Transparency Nos. 18–19.

National Electrical Manufacturers Association, "Fabrication And Installation Of High–Pressure Decorative Laminates," in *Standards Publication,* Pub. No. LD 2–1970, New York, New York, pp. 7–9, 18–21.

National Electrical Manufacturers Association, "high–pressure decorative laminates," in *Standards Publication/No. LD 3–1980,* Washington, DC, Part 4 pp. 12–14.

Spielman, Patrick E., "Woodworking With Plastic Laminates," in *Instructor's guide,* by DCA Educational Products, Warrington, PA 1979, pp. 1–4 and Transparency Nos. WPL 1, 6, 8, 13, 14.

Spielman, Patrick E., *Router Handbook,* by Sterling Publishing Co., Inc., New York, New York, 1983, pp. 116–118.

Hackett–Spielman, *Modern Wood Technology,* by Bruce, a division of Benziger Bruce & Glencoe, Inc., pp. 307–308, 1968.

Wagner, Willis H., *Modern Woodworking Tools, Materials and Procedures,* by The Goodheart–Willcox Co., Inc., South Holland, Illinois, 1970, pp. 20–12, 20–13.

O'Neill, James M., *Fabricating With Formica,* by The Bruce Publishing Company, Milwaukee, 1958, pp. 21–23, 34–36, 56–58.

Formica Corporation, "Plastics," by Formica Brand Industrial Platics, Cincinnati, Ohio, Form No. 7105 10/66, pp. 1–11.

Bougle, Thomas D., "Declaration of Thomas D. Bougle," in The United States District Court For The District of Maryland, Civil Action No. JFM 00 CV 2543, Jan. 4, 2001, pp. 1–4.

* cited by examiner

*Primary Examiner*—Andres Kashnikow

(57) ABSTRACT

A floor panel for elevated floors and the like is disclosed in which a high-pressure laminate floor covering is laminated to the load surface of the panel base. The laminate is provided with a decorative exposed surface and an inner body portion rearwardly therefrom having a color contrasting with the decorative exposed surface. A border is provided around the edge of the panel by cutting away the decorative surface to expose the contrasting inner body portion.

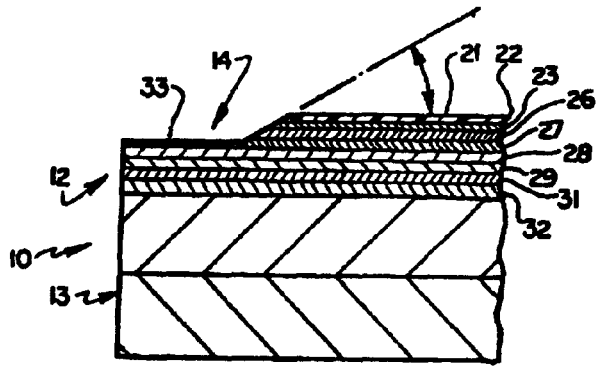

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–13 is confirmed.

* * * * *